US010709194B2

(12) United States Patent
Johnstone et al.

(10) Patent No.: US 10,709,194 B2
(45) Date of Patent: Jul. 14, 2020

(54) POWERED AIR RESPIRATOR KIT

(71) Applicant: JSP Limited, Witney Oxfordshire (GB)

(72) Inventors: Clive Johnstone, Witney (GB); Stephen Hare, Witney (GB); Andre Broodryk, Oxford (GB)

(73) Assignee: JSP Limited, Oxfordshire (GB)

( * ) Notice: Subject to any disclaimer, the term of this patent is extended or adjusted under 35 U.S.C. 154(b) by 266 days.

(21) Appl. No.: 15/753,898

(22) PCT Filed: Aug. 18, 2016

(86) PCT No.: PCT/GB2016/052550
§ 371 (c)(1),
(2) Date: Feb. 20, 2018

(87) PCT Pub. No.: WO2017/032981
PCT Pub. Date: Mar. 2, 2017

(65) Prior Publication Data

US 2018/0242679 A1 Aug. 30, 2018

(30) Foreign Application Priority Data

Aug. 25, 2015 (GB) ..... 1515081.6

(51) Int. Cl.
*A42B 3/22* (2006.01)
*A42B 3/28* (2006.01)
(Continued)

(52) U.S. Cl.
CPC ..... *A42B 3/225* (2013.01); *A42B 3/288* (2013.01); *A62B 18/003* (2013.01); *A62B 18/045* (2013.01); *A62B 7/10* (2013.01)

(58) Field of Classification Search
CPC ..... A62B 17/04; A62B 18/00; A62B 18/003; A62B 18/006; A62B 18/02; A62B 18/025;
(Continued)

(56) References Cited

U.S. PATENT DOCUMENTS 3,822,698 A * 7/1974 Guy ..... A62B 18/045 128/201.25
4,549,542 A * 10/1985 Chien ..... A62B 18/045 128/201.24
(Continued)

FOREIGN PATENT DOCUMENTS

CN 101795589 A 8/2010
CN 101795645 8/2010
(Continued)

OTHER PUBLICATIONS

International Search Report from International Application No. PCT/GB2016/052550, dated Nov. 7, 2016.
(Continued)

*Primary Examiner* — Joseph D. Boecker
(74) *Attorney, Agent, or Firm* — Morse, Barnes-Brown & Pendleton, P.C.; Sean D. Detweiler

(57) ABSTRACT

A powered air respirator kit comprising visor (9) removably attachable to a front edge of a safety helmet (4), a drive unit (1) removably attachable to said safety helmet (4), at least one filter module removably attachable to said safety helmet such that, in use, a fluid flow path is defined through said filter module to a space defined between a user's face and an inner surface of said visor, the kit further comprising a power module (10) removably attachable to said safety helmet and, in use, electrically connectable to said drive unit (1).

21 Claims, 8 Drawing Sheets

(51) Int. Cl.
*A62B 18/04* (2006.01)
*A62B 18/00* (2006.01)
*A62B 7/10* (2006.01)

(58) Field of Classification Search
CPC ..... A62B 18/04; A62B 18/045; A62B 7/10; A62B 23/02; A42B 3/221; A42B 3/225; A42B 3/28; A42B 3/286; A42B 3/288
See application file for complete search history.

(56) References Cited

U.S. PATENT DOCUMENTS 4,730,612 A * 3/1988 Dampney ..... A62B 18/045 128/201.24
5,054,479 A * 10/1991 Yelland ..... A61F 9/02 128/201.25
5,533,500 A * 7/1996 Her-Mou ..... A42B 3/288 128/201.24
5,577,495 A * 11/1996 Murphy ..... A42B 3/225 128/201.22
5,655,374 A * 8/1997 Santilli ..... A41D 13/1218 2/905
5,878,742 A * 3/1999 Figueredo ..... A42B 3/288 128/201.24
6,016,805 A * 1/2000 Burns ..... A42B 3/10 128/200.28
2009/0055987 A1 3/2009 Becker et al.
2009/0260135 A1 10/2009 Haselmayer
2012/0024289 A1* 2/2012 Johnstone ..... A42B 3/288 128/205.12
2013/0014651 A1 1/2013 Borrel
2013/0014751 A1 1/2013 Ausen
2014/0143934 A1* 5/2014 Grzybowski ..... A42B 3/286 2/171.3
2016/0030779 A1* 2/2016 Twu ..... A62B 7/10 128/202.13

FOREIGN PATENT DOCUMENTS

CN 204388252 U 6/2015
CN 104815404 A 8/2015
EP 2 859 803 4/2015
GB 2482320 2/2012
GB 2524676 9/2015

OTHER PUBLICATIONS

International Preliminary Report on Patentability from International Application No. PCT/GB2016/052550, dated Mar. 8, 2018.
GB Search Report from Great Britain Application No. GB1515081.6, dated Feb. 13, 2016.

* cited by examiner

POWERED AIR RESPIRATOR KIT

RELATED APPLICATION(S)

This application is a national stage filing under 35 U.S.C. 371 of International Application No. PCT/GB2016/052550, filed Aug. 18, 2016, which claims priority to United Kingdom Application No. 1515081.6, filed Aug. 25, 2015. International Application No. PCT/GB2016/052550 was published under PCT Article 21(2) in English, the entire teachings of which are incorporated by reference herein.

This invention relates generally to a powered air respirator kit for use in atmospheres that are contaminated with dust fumes, gases or vapours that may be hazardous to health.

Many different types of respirator apparatus have been proposed and used in various fields for many years. Such apparatus can be considered in two different categories:

Head mounted systems; and

Waist mounted systems.

Head mounted systems tend to be bespoke respirator systems, having a helmet incorporating a visor and carrying a drive and filter module, with or without a power source. Such systems tend to be heavy and uncomfortable to wear and, as a result, there is a constant drive to reduce the weight of the overall assembly. In known such bespoke respirator systems, this has usually involved a reduction in thickness and/or coverage of the helmet, thus reducing its capacity for protection and eliminating the ability for such helmets to have the required statutory safety certification of normal safety helmets.

An alternative solution to the above-mentioned weight problem has been proposed, in the form of waist mounted systems, wherein the helmet is still provided with an integral visor, but the respirator assembly itself is carried by the user around their waist, with a pipe or duct extending between an opening in the visor and the respirator assembly. Such systems are complex and the extension of a pipe along the user's upper body can restrict their movement. In both cases, and in use, the operative must utilise the head protection afforded by the system itself, rather than being able to use the safety helmet they normally use and feel most comfortable in.

It is an object of aspects of the present invention to address at least some of these issues, and provide a powered air respirator assembly that can be removably fitted to a standard safety helmet, having full statutory safety certification, as and when the need arises, and removed again when the apparatus is no longer required.

In accordance with an aspect of the present invention, there is provided a powered air respirator kit comprising visor removably attachable to a front edge of a safety helmet, a drive unit removably attachable to said safety helmet, at least one filter module removably attachable to said safety helmet such that, in use, a fluid flow path is defined through said filter module to a space defined between a user's face and an inner surface of said visor, the kit further comprising a power module removably attachable to said safety helmet and, in use, electrically connectable to said drive unit.

The kit may comprise a gasket which is removably attachable to a front edge of said safety helmet, and is configured to removably receive at least a portion of said drive unit and/or said filter module. The gasket may be of a curved configuration so as to extend around a corresponding curved portion of said front edge of said safety helmet.

In an exemplary embodiment, at least one filter module may be mounted on said drive unit such that, in use, said at least one filter module is removably attachable to said safety helmet via said drive unit. A filter module may be mounted on each side of said drive unit, and said drive unit may be removably attachable to said safety helmet at a generally central location at the front edge thereof.

The power module may be configured to be removably attachable at the rear of said safety helmet. In an exemplary embodiment, the power module may be configured to be removably attachable to a rear strap of an inner harness of said safety helmet.

The kit may comprise a sealing skirt configured to be removably attached to the side and lower edges of said visor.

In an exemplary embodiment, the kit may comprise a pair of adaptors, each being removably connectable to a side surface of said safety helmet, and an elongate visor carrier member on which said visor can be mounted and having, at each distal end thereof, connector members configured, in use, to pivotally engage with respective said adaptors. In this case, the kit may further comprise a pair of ear defender assemblies, each including a connector member, wherein said connector members are configured to adjustably engage with respective said adaptors.

The visor carrier may comprise a curved band configured, in use, to be connected to said front edge of said safety helmet. The visor carrier may comprise a peak portion extending substantially horizontally from a generally central portion of said band, wherein, in use, said visor extends downwardly from said band such that a first portion of said peaked portion extends beyond a front edge of said visor and a second portion of said peaked portion extends between the rear of the band and the front edge of the safety helmet. In this case, the gasket may comprise a grill member extending substantially horizontally therefrom, wherein said grill member engages with said second portion of peaked portion of said visor carrier, in use. The second portion of said peaked portion of said visor carrier may include at least one opening therein, and said gasket is configured to, in use, receive said drive unit such that a fluid flow path is defined between said at least one filter module and said opening. The at least one opening may be provided with a guidance duct configured to direct air away from a user's eyes onto a rear surface of said visor, in use. The duct may comprise a bisected pre-plenum portion and at least one turning vane on one side, the opposing side being at least partially open.

In an exemplary embodiment, at least one light emitting device may be provided in or on said first portion of said peaked portion of said visor carrier, said light emitting device being electrically connectable to said power module, said drive unit and/or said at least one filter module. At least one angled transmission vane may be provided between the band and a lower surface of said first portion of said peaked portion of said visor carrier, said transmission vane being configured to guide light from said at least one light emitting device to an inner surface of said visor, in use. Said at least one transmission vane may be formed of transparent plastic material. In an exemplary embodiment, a plurality of light emitting devices may be provided in or on the first portion of said peak portion of said visor carrier, wherein a plurality of respective transmission vanes, arranged substantially parallel to each other, may be provided for guiding light from each respective light emitting device to an inner surface of said visor, in use. The or each said transmission vane may have an angled edge comprising two sections, wherein each section extends at the same angle from the lower surface of the peaked portion and the band respectively. The angle may be substantially 55°.

In accordance with another aspect of the present invention, there is provided a visor carrier for a kit as described above, said visor carrier comprising a curved band configured, in use, to be removably connected to said front edge of said safety helmet, and a peak portion extending substantially horizontally from a generally central portion of said band, wherein, in use, said visor extends from said band such that a first portion of said peaked portion extends beyond a front edge of said visor and a second portion of said peaked portion extends between the rear of the band and the front edge of the safety helmet.

In accordance with another aspect of the present invention, there is provided gasket for a kit as described above and for use with the visor carrier described above, the gasket being configured, in use, to be removably connected to said front edge of said safety helmet and having a curved configuration so as to extend, in use, around a corresponding curved portion of said front edge of said safety helmet.

In accordance with yet another aspect of the present invention, there is provided a powered air purifying respirator comprising a safety helmet having a visor, a drive unit and at least one filter module removably attached thereto.

The drive unit may be removably attached to said safety helmet at a front edge thereof, and further comprising a power module removably attached to a rear portion of said safety helmet.

These and other aspects of the present invention will be apparent from the following specific description in which embodiments of the present invention are described, by way of examples only, and with reference to the accompanying drawings, in which.

Figure 6:
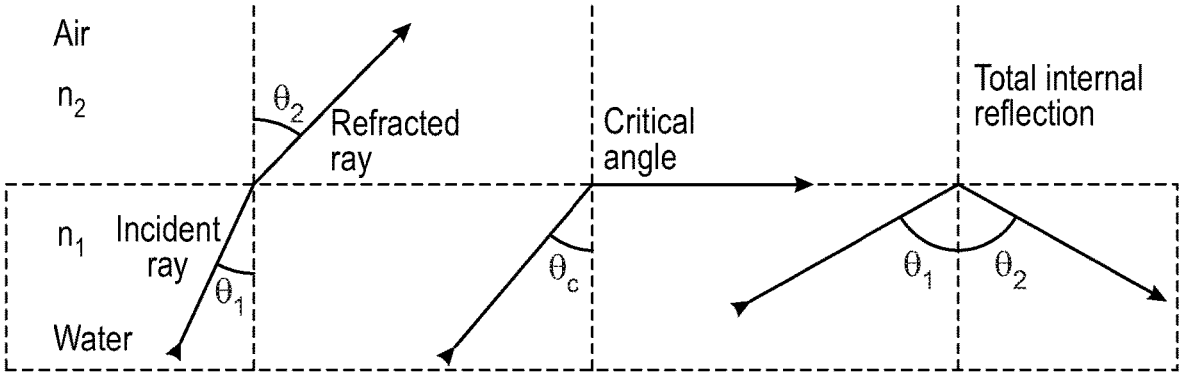
FIG. 6 is a schematic diagram illustrating the functionality of a the light transmission vanes in a visor carrier for use in an exemplary embodiment of the present invention.
Figure 6:
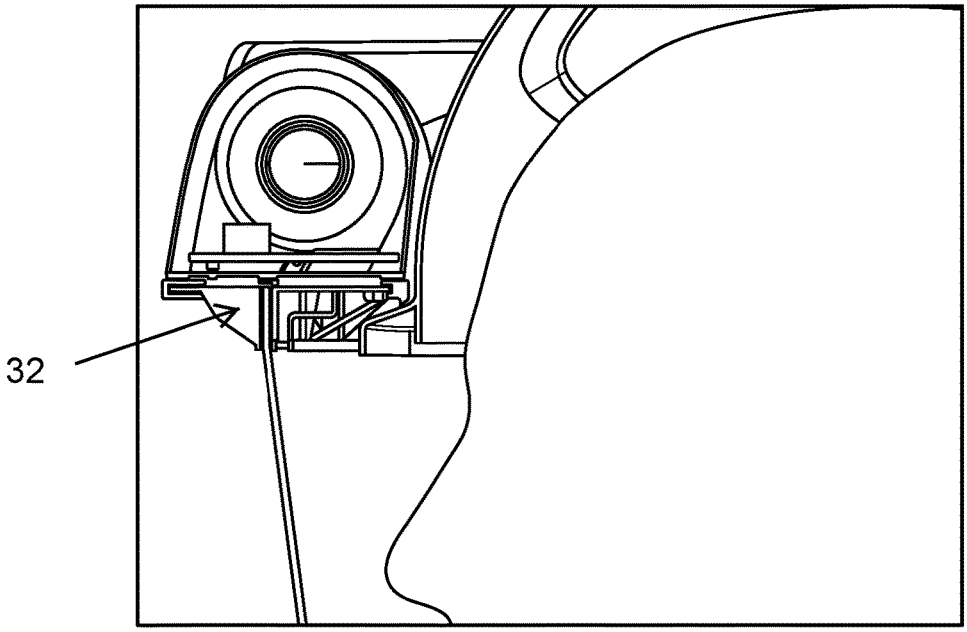
Figure 7A:
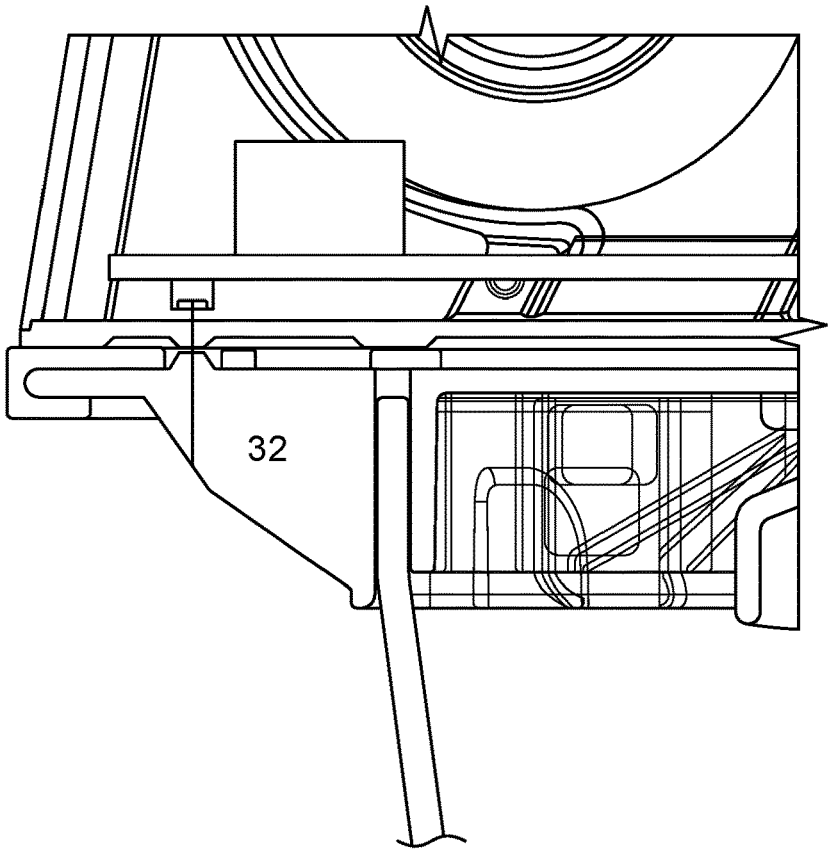
Figure 7B:
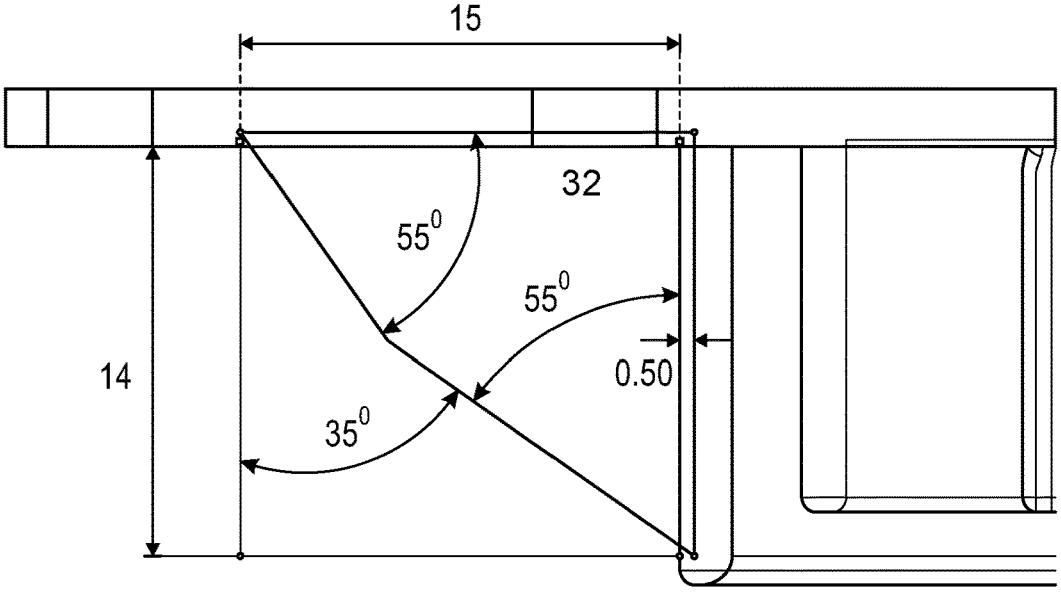
Figure 8:
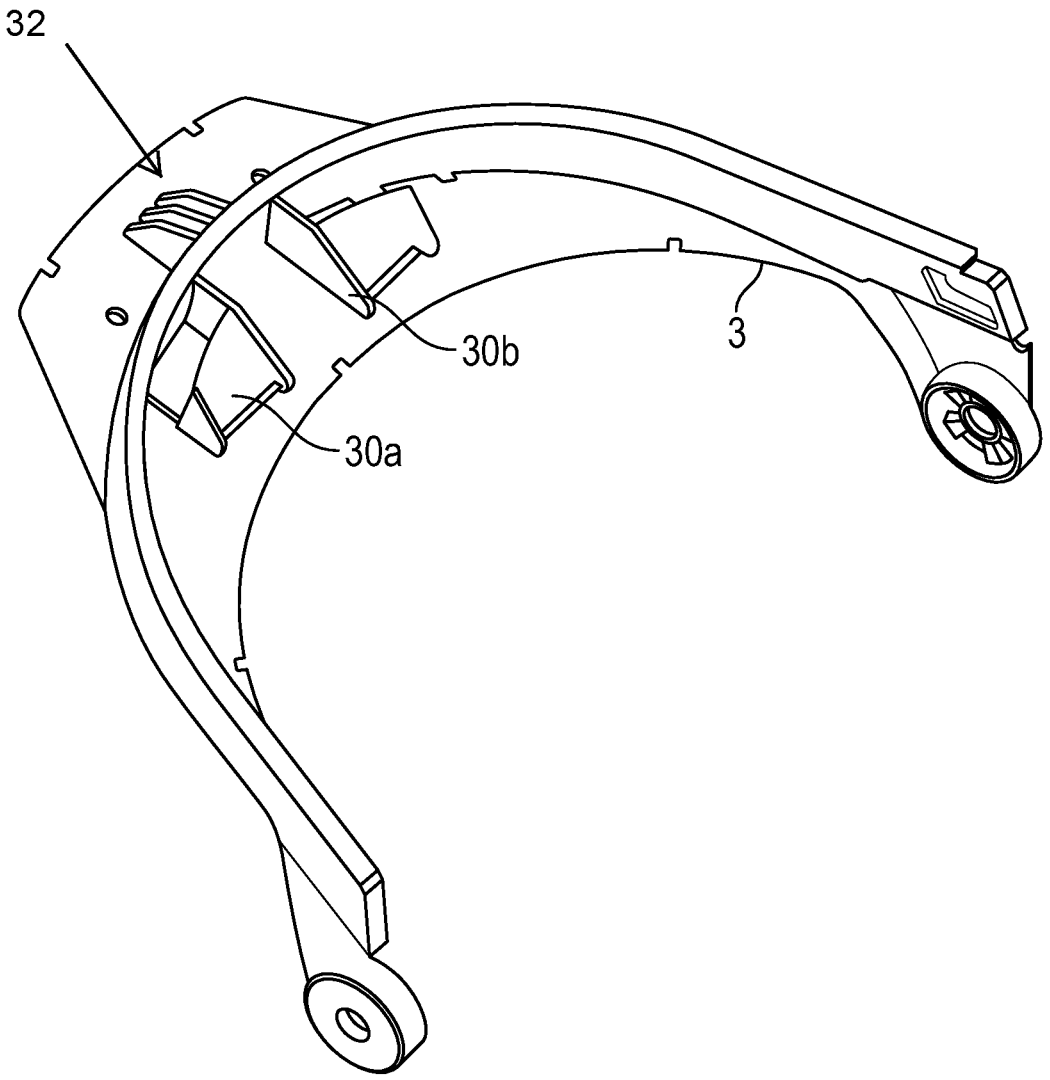

FIGS. 7*a* and 7*b* are schematic side views illustrating an exemplary profile of the light transmission vanes of FIG. 6; and FIG. 8 is a schematic perspective bottom view of a visor carrier for use in an exemplary embodiment of the present invention, illustrating the air directing vents.

Figure 1:
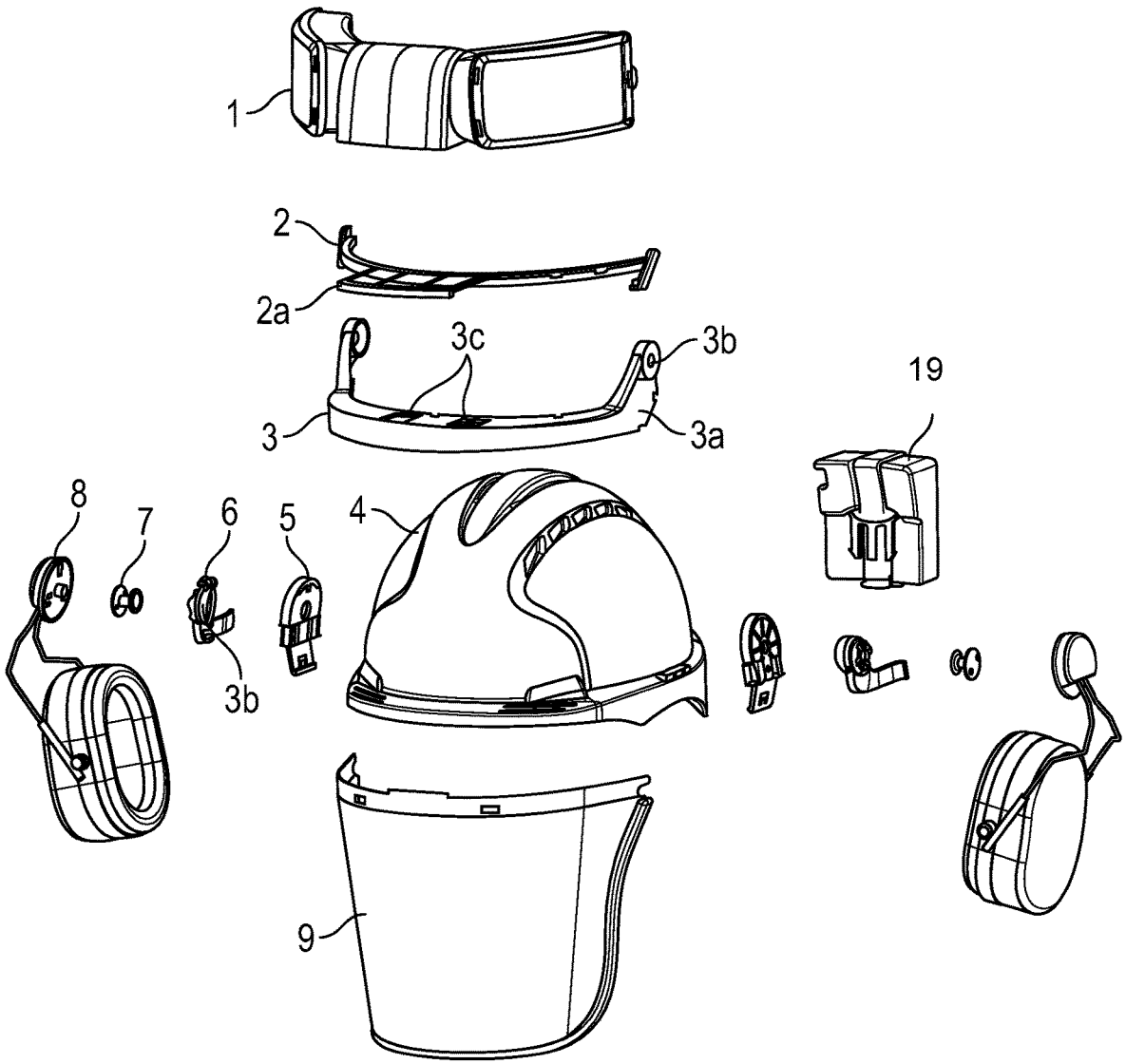
FIG. 1 is an exploded schematic diagram illustrating the constituent parts of a powered air purifying respirator kit according to an exemplary embodiment of the present invention.

Referring to FIG. 1 of the drawings, a powered air (purifying) respirator PAPR kit according to an exemplary embodiment of the present invention comprises a drive and filter unit 1, a visor gasket 2, a visor carrier 3 and a visor 9.

Figure 2:
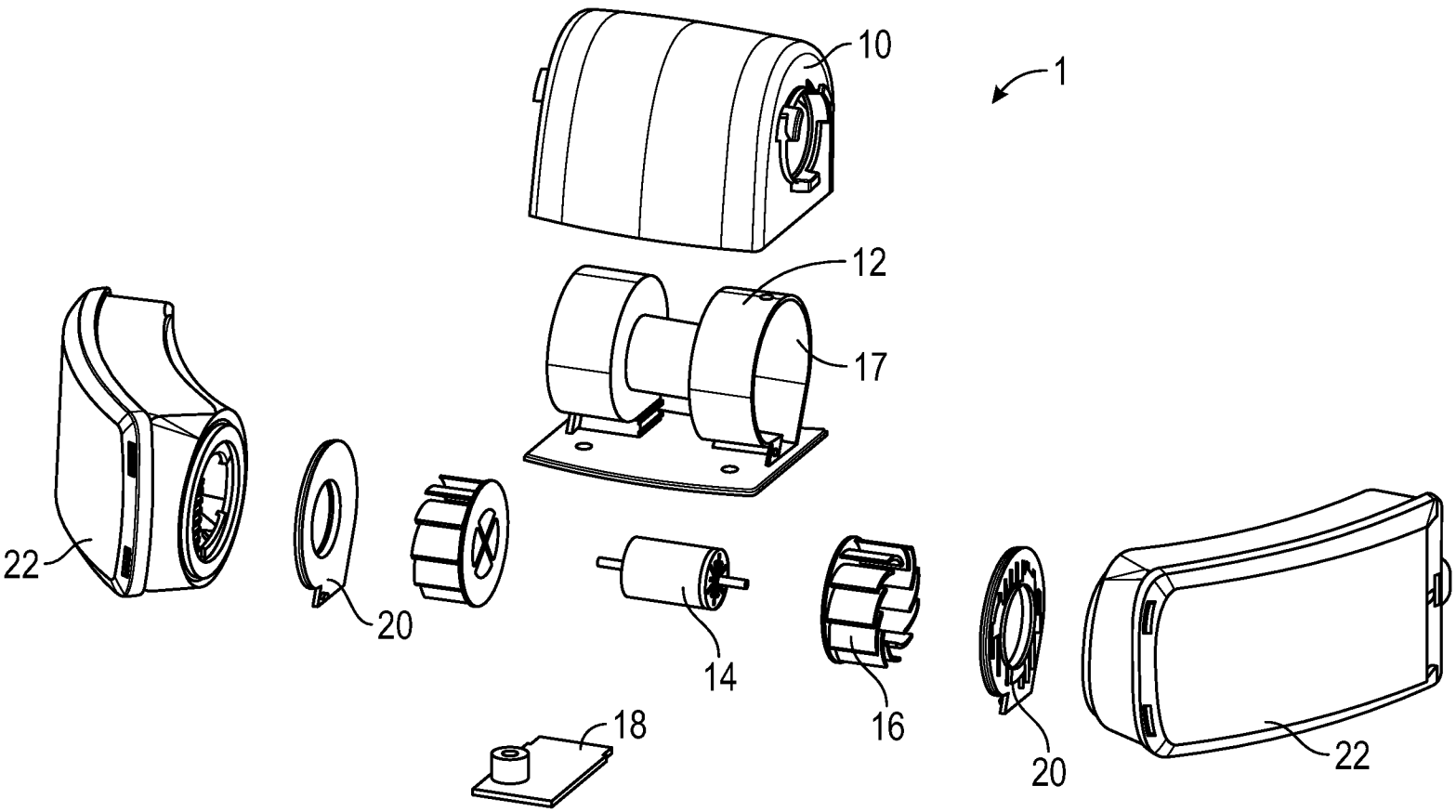
FIG. 2 is an exploded schematic diagram illustrating the constituent parts of a drive and filter assembly unit for use in an exemplary embodiment of the present invention.

Referring additionally to FIG. 2 of the drawings, the drive and filter unit 1 comprises a generally central drive unit consisting of a housing or cowl 10 within which is housed a volute 12 defining a generally central horizontal channel therethrough, between openings in the side edges of the cowl 10. A motor 14 is mounted within the volute channel and communicably coupled at each distal end of its shaft to a respective impeller 16. A drive PCB 18 is mounted at the base of the volute 12, for driving the motor 14 (and, optionally, generating signals for operating an indicator LED as will be described later). The impellers 16 are housed within respective recesses 17 at each end of the volute 12 and a respective volute lid 20 is used to cover the end of each recess 17, each volute lid defining a generally central opening defining a fluid flow path for the respective impeller, in use.

Figure 3:
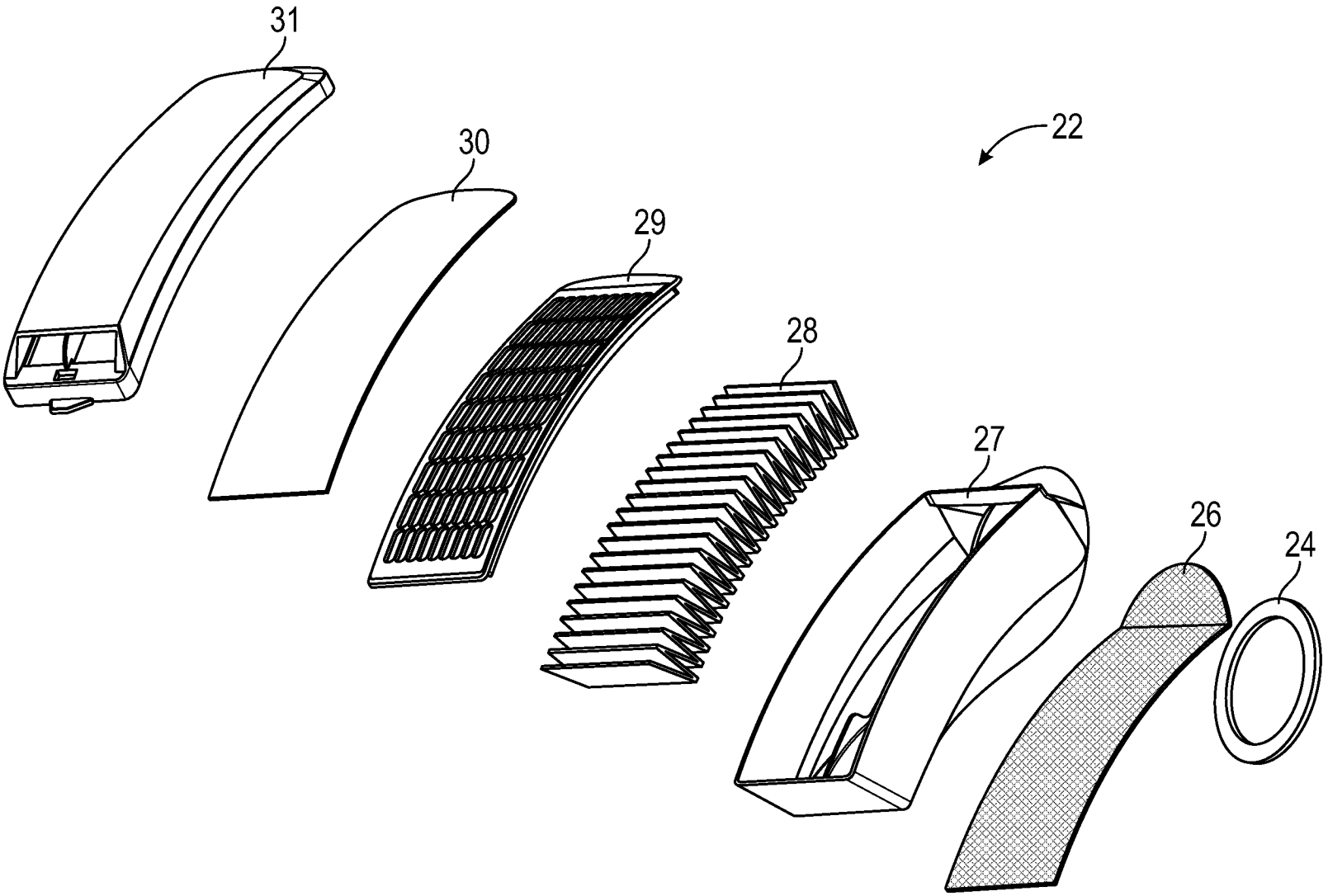
FIG. 3 is an exploded schematic diagram of the constituent parts of a filter assembly for use in an exemplary embodiment of the present invention.

On each side of the drive unit, there is provided a filter assembly 22. Referring additionally to FIG. 3 of the drawings, each filter assembly is communicably coupled to the fluid flow path from a respective impeller 16 via a filter gasket 24 coupled to a respective volute lid 20. As shown in FIG. 3, each filter assembly 22 additionally comprises a finger mesh 26, a filter case 27, some form of filter media 28, a filter grill 29, a pre-filter member 30 and a pre-filter cover 31. However, it will be appreciated by a person skilled in the art that other filter assembly configurations can be used, and the present invention is not necessarily intended to be limited in this regard.

Referring back to FIG. 1 of the drawings, it can be seen that, in the assembled form, the drive and filter unit 1 is curved to generally correspond with the curve of the outer front wall of a safety helmet 4.

The visor gasket 2 comprises a similarly curved gasket member having a grill member 2*a* extending substantially horizontally from a generally central front portion thereof. The visor carrier 3 comprises a curved band member having, at each distal end, an arm 3*a* pivotally mounted thereon. Each arm 3*a* terminates in a connector member 3*b*. The connector members 3*b* are configured to enable the visor carrier 3 to be hingedly connected to the safety helmet 4 by means of a pair of adaptors (4*a*—FIG. 4) removably clipped thereon.

The generally central front portion of the band member of the visor carrier 3 is provided with an integral peaked portion comprised of a front portion that extends forward of the band member and is outwardly curved, and a rear portion that extends rearward of the band member and is inwardly curved to generally correspond with the curved front edge of the safety helmet 4. A pair of openings 3*c* is provided in the rear portion.

Figure 4:
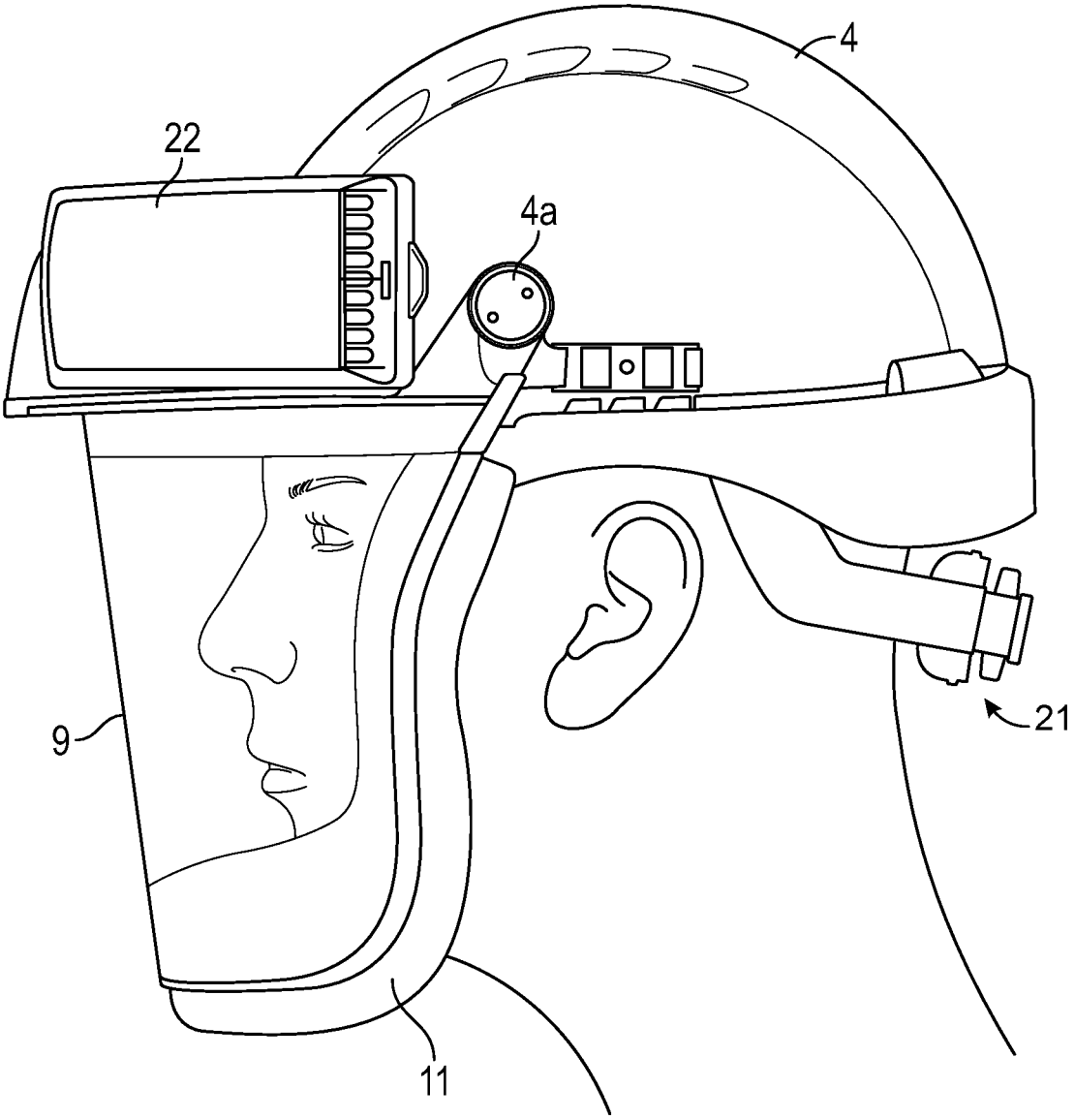
FIG. 4 is a side view illustrating a powered air respirator assembly according to an exemplary embodiment of the present invention, when in use.

In the assembled form, and referring additionally to FIG. 4 of the drawings, the visor gasket 2 is removably mounted to the front edge of the safety helmet 4 and the drive and filter unit is coupled to the gasket such that it sits across the front surface of the safety helmet 4, and such that a fluid flow path is defined from the atmosphere, through the filter assemblies, down through the grill member 2*a* in the visor gasket. In use, the impellers, driven by the motor, draw air from the atmosphere through the filter assemblies and direct it out through the grill member 2*a*.

The visor carrier 3 is pivotally mounted at the side edges of the helmet 4, via the connector members 3*b* and adaptors 4*a*, and the visor 9 is mounted to the visor carrier 3. The visor 9 is thus pivotable (via the visor carrier 3) between an operative position, in which it covers a user's face(shown), and an inoperative position in which the visor 9 is pivotally lifted up and away from the user's face. A removable sealing skirt 11 may be provided around the side and lower edges of the visor 9 so as to provide a seal between the visor 9 and the user's face, if required and depending on the environment in which the assembly is to be used. In use, air drawn through the filter assemblies and directed through the grill member 2*a* of the visor gasket 2 by the impellers 16, passes through the openings 3*c* into the space defined between the rear or inner surface of the visor 9 and the user's face.

Referring back to FIG. 1 of the drawings, a powered air purifying respirator kit according to an exemplary embodiment of the invention further comprises an adaptor 5 which can be removably clipped at a side edge of the safety helmet 4. The adaptor 5 is, in this case, configured not only to receive the connector members 3*b* at the end of the visor carrier arms 3*a*, but also ear defender assemblies (discussed below), so that their configuration may be different to that required if only the visor (and not the ear defenders) are required to be mounted to the safety helmet 4. The visor carrier connector members 3*b* are connected to the respective adaptors 5 via a visor pivot fastener 7. An ear defender assembly 8 is subsequently connectable to the adaptors 5 to complete the assembly process.

Referring additionally to FIG. 4 of the drawings, a battery box assembly 19 is removably mountable on the rear strap 21 of the helmet harness and acts to counter-balance the weight of the drive and filter unit 1 at the front. A power cable (not shown) is provided to electrically connect the battery box 19 to the drive PCB 18 of the drive unit. Thus, the modular kit can be mounted as shown in FIG. 4, for use as required and only the elements thereof required for a particular job need to be mounted (i.e. only the visor, the visor and sealing skirt assembly, or the visor and ear defenders). When the kit is not in use, it can be removed from the safety helmet 4 altogether and the safety helmet, which can be a standard safety helmet conforming to safety standards such as EN397 certification, can be used as such.

Figure 5:
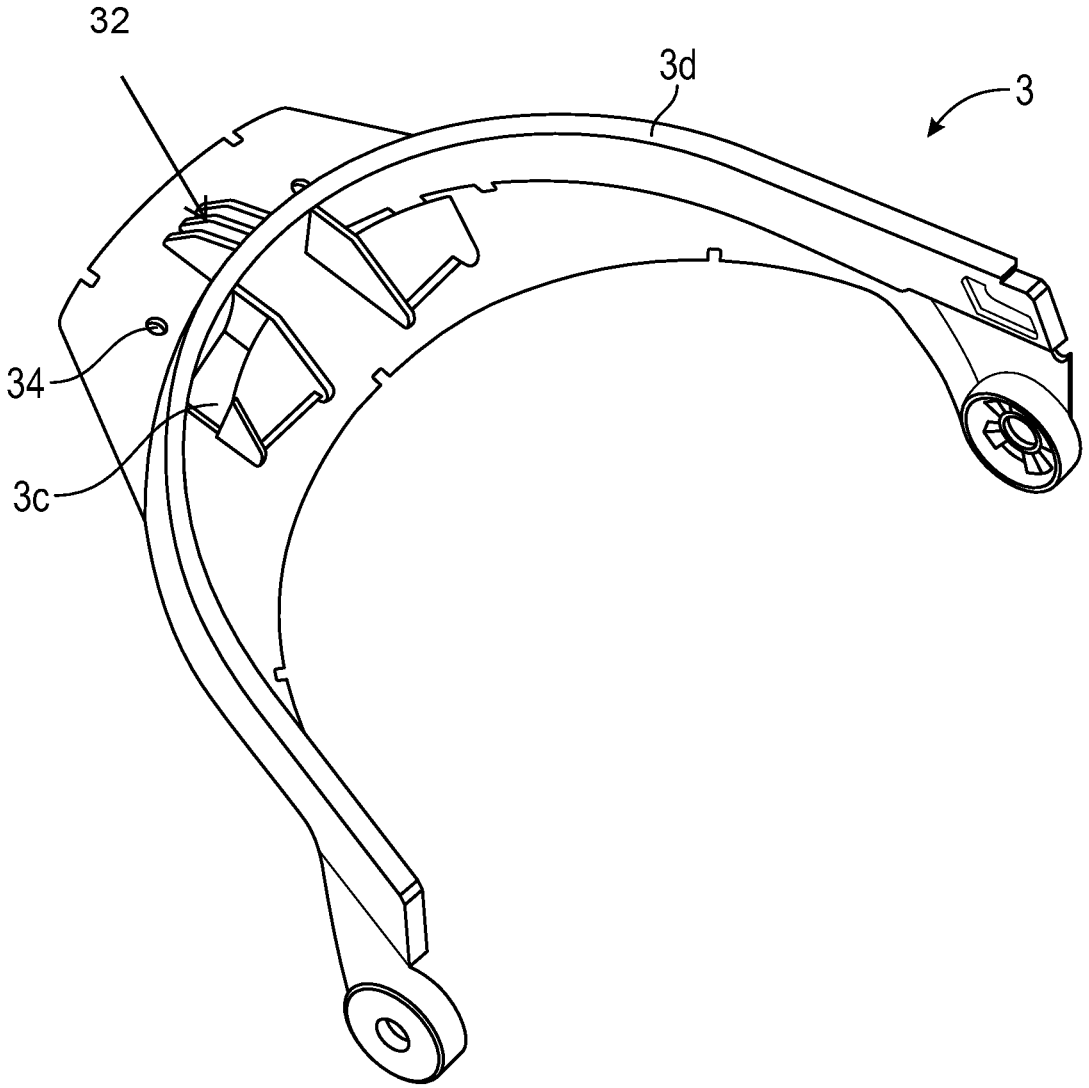
FIG. 5 is a schematic perspective bottom view of a visor carrier for use in an exemplary embodiment of the present invention.

Referring now to FIG. 5 of the drawings, the lower surface of the rear part of the peaked portion of the visor carrier 3 is provided with air flow directing vents 30 in respect of the openings 3*c*, and a set of light transmission vanes 32 on the lower surface of the front portion of the above-mentioned peaked portion of the visor carrier 3.

Considering first the transmission vanes 32, these comprise a set (in this case, three) angled 'light pipes' formed of transparent plastic (e.g. ABS). A set of three warning LEDs 34 are provided in the front portion of the above-mentioned peak portion, in this case, a red LED, a blue LED and a green LED may be provided. The LEDs 34 are intended to provide information to a user (and others) as to the condition of the battery and/or the filter assemblies, but their actual position relative to the user's eyes (in use) is such that they are barely, if at all, visible to the user. Thus, the transmission vanes 32 are configured to refract the output of the LEDs 34 downward from the peaked portion of the visor carrier 3 toward the inner surface of the visor 9 which, in turn, reflects the light back to the user's eyes, thereby providing a heads-up indicator display to the user, during normal use. The angle of the vanes 32 is such that they provide an internal reflection surface at an angle of incidence greater than the critical angle, as illustrated in FIG. 6 of the drawings. Thus, each vane 32 is angled from a point closest to the front of the peaked portion (on the lower surface) to the curved band 3*d*. Referring to FIG. 7 of the drawings, an optimum profile of the angled edge of each vane 32 to achieve the desired result is illustrated. As shown, the angle between the edge and the lower surface of the peaked portion is around 55° in this case and changes at around a third of the way along the edge such that the angle between the edge and the vertical surface defined by the band 3*d* is also around 55°. Thus, more generally, an advantageous configuration of the angled edge may be in the form of two angled portions, a first portion at a first angle relative to the lower (horizontal) surface of the peaked portion and a second portion at a second angle relative to the vertical (inner) surface of the carrier band 3*d*; and, in an exemplary embodiment, the first and second angles may be substantially identical. However, other suitable angle configurations may be apparent to a person skilled in the art and the present invention is not necessarily intended to be limited in this regard.

The pattern of warning light indicators may, for example, be as follows:

| | |
|---|---|
| Static green (only) | All systems good |
| Static green and flashing red | Battery approaching flat |
| Flashing red (only) | Flat battery |
| Static green and flashing blue | Blocking filter |
| Flashing blue (only) | Blocked filter |

but the present invention is not necessarily intended to be in any way limited in this regard.

Referring now to FIG. 8 of the drawings, the air flow directing vent members 30 are intended to prevent irritation and drying of a user's eyes by directing air, drawn by the impellers through the filter assemblies and into the space between the inner surface of the visor 9 and the user's face, away from the user's eyes toward the inner surface of the visor 9. As shown, the vents 30 may, advantageously, each comprise a bisected pre-plenum portion 30*a* combined with a turning vane 30*b*, with each vent having an open side to maintain optimal cross-sectional open area such that flow is directed away from the eyes and attached to the visor 9, minimising recirculation, whilst pressure against the impellers is not overly increased.

It will be apparent to a person skilled in the art, from the foregoing description, that modifications and variations can be made to the described embodiments without departing from the scope of the invention as defined by the appended claims.

The invention claimed is:

1. A powered air respirator kit comprising a visor removably attachable to a front edge of a safety helmet, a drive unit removably attachable to said safety helmet, at least one filter module removably attachable to said safety helmet such that, in use, a fluid flow path is defined through said filter module to a space defined between a user's face and an inner surface of said visor, said kit further comprising a power module removably attachable to said safety helmet and, in use, electrically connectable to said drive unit;

wherein said power module is configured to be removably attachable at a rear of said safety helmet; and wherein said kit further comprises an inner harness of said safety helmet and said power module is configured to be removably attachable to said rear strap of said inner harness of said safety helmet.

2. A kit according to claim 1, comprising a gasket which is removably attachable to said front edge of said safety helmet, and is configured to removably receive at least a portion of said drive unit and/or said filter module.

3. A kit according to claim 2, wherein said gasket is of a curved configuration so as to extend around a corresponding curved portion of said front edge of said safety helmet.

4. A kit according to claim 1, wherein said at least one filter module is mounted on said drive unit such that, in use, said at least one filter module is removably attachable to said safety helmet via said drive unit.

5. A kit according to claim 4, wherein said at least one filter module comprises two filter modules, wherein a filter module is mounted on each side of said drive unit, and said drive unit is removably attachable to said safety helmet at a generally central location at said front edge thereof.

6. A kit according to claim 1, comprising a sealing skirt configured to be removably attached to side and lower edges of said visor.

7. A powered air respirator kit comprising a visor removably attachable to a front edge of a safety helmet, a drive unit removably attachable to said safety helmet, at least one filter module removably attachable to said safety helmet such that, in use, a fluid flow path is defined through said filter module to a space defined between a user's face and an inner surface of said visor, said kit further comprising a power module removably attachable to said safety helmet and, in use, electrically connectable to said drive unit comprising a pair of adaptors, each being removably connectable to a side surface of said safety helmet, and an elongate visor carrier member on which said visor can be mounted and having, at each distal end thereof, connector members configured, in use, to pivotally engage with respective said adaptors; and further comprising a pair of ear defender assemblies, each including one of said connector members, wherein said connector members are configured to adjustably engage with respective said adaptors.

8. A kit according to claim 7, wherein at least one of said visor carrier member comprises a curved band configured, in use, to be connected to said front edge of said safety helmet; and said visor carrier member comprises a peak portion extending substantially horizontally from a generally central portion of said band, wherein, in use, said visor extends downwardly from said band such that a first portion of said peaked portion extends beyond a front edge of said visor and a second portion of said peaked portion extends between a rear of said band and said front edge of said safety helmet.

9. A kit according to claim 8, further comprising a gasket configured, in use, to be removably connected to said front edge of said safety helmet and having a curved configuration so as to extend, in use, around a corresponding curved portion of said front edge of said safety helmet; wherein said gasket comprises a grill member extending substantially horizontally therefrom, wherein said grill member engages with said second portion of said peaked portion of said visor carrier member, in use; and said second portion of said peaked portion of said visor carrier member includes at least one opening therein, and said gasket is configured to, in use, receive said drive unit such that a fluid flow path is defined between said at least one filter module and said opening.

10. A kit according to claim 9, wherein at least one of said at least one opening is provided with a guidance duct configured to direct air away from a user's eyes onto a rear surface of said visor, in use; and said duct comprises a bisected pre-plenum portion and at least one turning vane on one side, the opposing side being at least partially open.

11. A kit according to claim 10, wherein at least one light emitting device is provided in or on said first portion of said peaked portion of said visor carrier member, said light emitting device being electrically connectable to said power module, said drive unit and/or said at least one filter module.

12. A kit according to claim 11, wherein at least one angled transmission vane is provided between said band and a lower surface of said first portion of said peaked portion of said visor carrier member, said at least one angled transmission vane being configured to guide light from said at least one light emitting device to said rear surface of said visor, in use; and wherein said at least one transmission vane is formed of transparent plastic material.

13. A kit according to claim 10, wherein a plurality of light emitting devices are provided in or on said first portion of said peaked portion of said visor carrier member, and a plurality of respective transmission vanes are provided between said band and a lower surface of said first portion of said peaked portion of said visor carrier member, said transmission vanes being configured to guide light from respective light emitting devices to said rear surface of said visor, in use.

14. A kit according to claim 13, wherein each of said transmission vanes has an angled edge comprising two sections, wherein each section extends at a same angle from said lower surface of said peaked portion and the band respectively; and said angle is substantially 55°.

15. A powered air respirator kit comprising a visor removably attachable to a front edge of a safety helmet, a drive unit removably attachable to said safety helmet, at least one filter module removably attachable to said safety helmet such that, in use, a fluid flow path is defined through said filter module to a space defined between a user's face and an inner surface of said visor, said kit further comprising a power module removably attachable to said safety helmet and, in use, electrically connectable to said drive unit; comprising a pair of adaptors, each being removably connectable to a side surface of said safety helmet, and an elongate visor carrier member on which said visor can be mounted and having, at each distal end thereof, connector members configured, in use, to pivotally engage with respective said adaptors;

wherein said visor carrier member comprises a curved band configured, in use, to be connected to said front edge of said safety helmet; and said visor carrier member comprises a peak portion extending substantially horizontally from a generally central portion of said band, wherein, in use, said visor extends downwardly from said band such that a first portion of said peaked portion extends beyond a front edge of said visor and a second portion of said peaked portion extends between a rear of said band and said from edge of said safety helmet.

16. A kit according to claim 15, further comprising a gasket configured, in use, to be removably connected to said front edge of said safety helmet and having a curved configuration so as to extend, in use, around a corresponding curved portion of said front edge of said safety helmet; wherein said gasket comprises a grill member extending substantially horizontally therefrom, wherein said grill member engages with said second portion of peaked portion of said visor carrier, in use; and said second portion of said peaked portion of said visor carrier member includes at last one opening therein, and said gasket is configured to, in use, receive said drive until such that a fluid flow path is defined between said at least one filter module and said opening.

17. A kit according to claim 16, wherein at least one of said at least one opening is provided with a guidance duct configured to direct air away from a user's eyes onto a rear surface of said visor, in use; and said duct comprises a bisected pre-plenum portion and at least one turning vane on one side, said opposing side being at least partially open.

18. A kit according to claim 17, wherein at least one light emitting device is provided in or on said first portion of said peaked portion of said visor carrier member, said light emitting device being electrically connectable to said power module, said drive unit and/or said at least one filter module.

19. A kit according to claim 18, wherein at least one angled transmission vane is provided between said band and a lower surface of said first portion of said peaked portion of said visor carrier member, said at least one angled transmission vane being configured to guide light from said at least one light emitting device to said rear surface of said visor, in use; and wherein said at least one transmission vane of formed of transparent plastic material.

20. A kit according to claim 17, wherein a plurality of light emitting devices are provided in or on said first portion of said peaked portion of said visor carrier member, and a plurality of respective transmission vanes are provided between said band and a lower surface of said first portion of said peaked portion of said visor carrier member, said transmission vanes being configured to guide light from respective light emitting devices to said rear surface of said visor, in use.

21. A kit according to claim 20, wherein each of said transmission vanes has an angled edge comprising two sections, wherein each section extends at a same angle from said lower surface of said peaked portion and said band respectively; and said angle is substantially 55°.

* * * * *